United States Patent [19]

Didsun et al.

[11] Patent Number: 4,969,394

[45] Date of Patent: Nov. 13, 1990

[54] INKING MECHANISM FOR POSTAGE METERS AND PRICE STAMPING MACHINES

[75] Inventors: Helmuth Didsun, Heusenstamm; Reinhard Redecker, Rodenbach; Wolfgang Von Inten, Berlin; Peter Rogge, Berlin; Hubert Schewczyk, Berlin; Kurt Götz, Munich, all of Fed. Rep. of Germany

[73] Assignee: Francotyp -Postalia GmbH, Berlin, Fed. Rep. of Germany

[21] Appl. No.: 350,503

[22] Filed: May 11, 1989

[30] Foreign Application Priority Data

May 11, 1988 [DE] Fed. Rep. of Germany ..... 3816548

[51] Int. Cl.[5] ..... B41F 31/00

[52] U.S. Cl. ..... 101/363; 101/330

[58] Field of Search ..... 101/348, 350, 330, 363, 101/331

[56] References Cited

U.S. PATENT DOCUMENTS

| | | | |
|---|---|---|---|
| 856,799 | 6/1907 | O'Conner et al. | 101/330 |
| 3,238,870 | 3/1966 | Matkovich | 101/363 |
| 3,662,682 | 5/1972 | Marozzi | 101/350 |
| 3,831,517 | 8/1974 | Wagner | 101/363 |
| 4,207,818 | 6/1980 | Hamisch | 101/348 |
| 4,210,476 | 7/1980 | McKay | 101/348 |

FOREIGN PATENT DOCUMENTS

| | | | |
|---|---|---|---|
| 60-63167 | 4/1985 | Japan | 101/363 |

*Primary Examiner*—Clifford D. Crowder
*Assistant Examiner*—Ren Yan
*Attorney, Agent, or Firm*—Herbert L. Lerner; Laurence A. Greenberg

[57] ABSTRACT

An inking mechanism for postage meters and price stamping machines includes an ink transport roller, an intermediate roller and an inking roller being operatively connected to one another and having surfaces. The surface of the intermediate roller transfers ink from the ink transport roller to the inking roller and the surface of the inking roller is formed of porous material. An ink supply container in the form of a tank has a slit-like opening formed therein. Porous material substantially fills the tank as a storage medium for stamp ink. The porous material protrudes out of the slit-like opening in the tank and contacts the surface of the ink transport roller in the form of a squeegee.

5 Claims, 1 Drawing Sheet

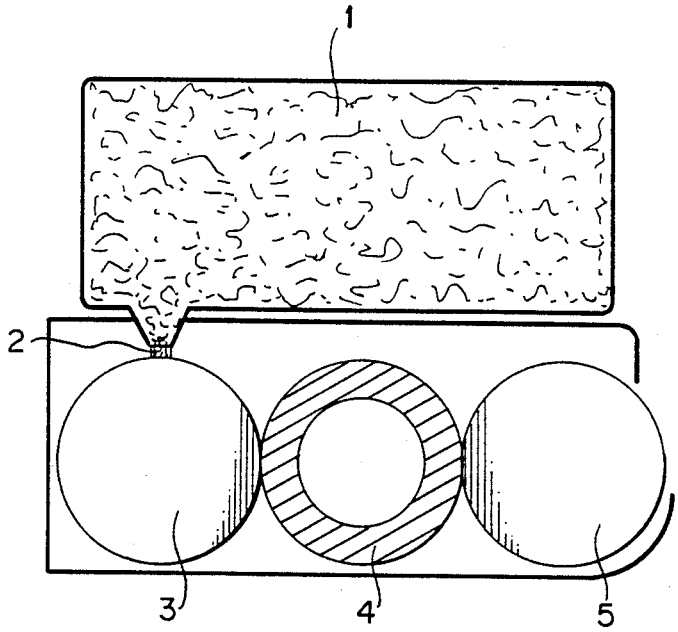
1
2
3
4
5

INKING MECHANISM FOR POSTAGE METERS AND PRICE STAMPING MACHINES

The invention relates to an inking mechanism for postage meters and price stamping machines that includes an intermediate roller and an inking roller, which are operatively connected to one another and are disposed in a common housing.

Systems having roller and cylinder-like transfer means are known as inking mechanisms for postage meters and stamping machines, such as from German Published, Non-Prosecuted Applications No. DE-OS 22 32 862 and 27 48 600 as well as German Patent No. DE-PS 33 16 558).

These systems have either an ink transport roller that continually dips into an ink supply container, as disclosed in German Patent No. DE-PS 33 16 558, or porous cylindrical bodies on the inside of an inking roller, as disclosed in German Published, Non-Prosecuted Applications No. DE-OS 22 32 862 and 27 48 600. With the latter structures, it is necessary to replace the entire inking roller when the inking of the characters become fainter. With the former structure, care must be taken to ensure that the supply of ink will not coagulate over relatively long periods of service.

Inking apparatus are also known that use containers with wicks as the means for transfer to the ink transport roller, as in German Patent No. DE-PS 11 38 264 and German Published, Non-Prosecuted Application No. DE-OS 22 05 992. In each case, the wick dips into the ink supply and distributes the ink over the ink transport roller. Uniformity of the ink distribution depends on the fill level of the container and on its location with respect to the ink transport roller.

Equivalents to the wick transfer systems are systems having ink containers which are constructed as cartridges or tanks with absorbent filler material that fills the cartridges halfway, as in U.S. Pat. No. 3,662,682 and British Patent No. 2,008,035. Uniformity of the ink output is not reliably assured with decreasing fluid pressure and perhaps with aging of the absorbent filler material and of the wick.

It is also known to provide a rotating ink cartridge with two different porous materials and to dispense ink to an applicator roller during a rotation of the ink cartridge, as disclosed in U.S. Pat. No. 3,491,685. The applicator roller is driven by the printing drum, and the rotation of the ink cartridge is controlled by the applicator roller. Regular maintenance of the applicator roller is necessary for uniform ink application, in order to avoid any slippage, for instance from ink that has coagulated on the surface of the applicator roller.

It is accordingly an object of the invention to provide an inking mechanism for postage meters and price stamping machines, which overcomes the hereinaforementioned disadvantages of the heretofore-known devices of this general type, which does necessitate replacing the inking rollers when the inking fades and which does not require ink supply containers as structural units of the roller housing that must be continuously refilled and must be cleaned after particular lengths of time. As a result, an inking mechanism that is structurally less expensive can be economically manufactured.

With the foregoing and other objects in view there is provided, in accordance with the invention, an inking mechanism for postage meters and price stamping machines, comprising an ink transport roller, an intermediate roller and an inking roller being operatively connected to one another and having surfaces, the surface of the intermediate roller transferring ink from the ink transport roller to the inking roller, the surface of the inking roller being formed of porous material, an ink supply container in the form of a tank having a slit-like opening with a certain shape formed therein, and porous material substantially filling the tank as a storage medium for stamp ink, the porous material protruding out of the slit-like opening in the tank and contacting the surface of the ink transport roller in the form of a squeegee.

In accordance with another feature of the invention, there is provided a common housing in which at least the intermediate roller and the inking roller are disposed.

In accordance with a concomitant feature of the invention, the porous material is expanded plastic, felt or nonwoven material.

Other features which are considered as characteristic for the invention are set forth in the appended claims.

Although the invention is illustrated and described herein as embodied in an inking mechanism for postage meters and price stamping machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single figure of the drawing.

The drawing is a diagrammatic, longitudinal-sectional view of an inking mechanism according to the invention.

Referring now to the single FIGURE of the drawing in detail, there is seen an inking mechanism including a tank 1 which contains stamp ink, an ink transport roller 3, an intermediate roller 4 and an inking roller 5, which finally transfers the ink to type or printing blocks. At least the rollers 4 and 5 are disposed in a common housing 6. The tank 1 used as the ink supply container is filled with porous material, which absorbs the stamp ink. By way of example, expanded plastics, felt, nonwovens, or other relatively large-celled absorbent materials may be used as the porous materials.

The tank 1 has a slit-like opening, which extends over the entire length of the ink transport roller 3. The porous material protrudes from the slit-like opening in the form of a squeegee, stripper, shedder or wiper 2 and rests on the ink transport roller 3.

Due to the rotation of the ink transport roller 3, the roller 3 takes up a thin ink film from the squeegee 2. The ink film is transferred to the intermediate roller 4. The surface of the intermediate roller 4 is formed of porous material and thus serves to absorb excess damp ink, both from the ink transport roller 3 and from the inking roller 5.

The surface of the inking roller 5, which transfers the stamp ink to the type and/or printing blocks, is likewise manufactured from porous material.

We claim:

1. Inking mechanism for postage meters and price stamping machines, comprising an ink transport roller having a given width, an intermediate roller and an inking roller being operatively connected to one another and having surfaces, said surface of said intermediate roller transferring ink from said ink transport roller to said inking roller, said surface of said inking roller being formed of porous material, an ink supply container in the form of a tank, said tank being closed except for a slit-like opening formed therein, and porous material substantially filling said tank as a storage medium for stamp ink, said porous material of said tank protruding out of said slit-like opening in said tank and contacting said surface of said ink transport roller over substantially said entire given width in the form of a squeegee.

2. Inking mechanism according to claim 1, including a common housing in which at least said intermediate roller and said inking roller are disposed.

3. Inking mechanism according to claim 1, wherein said porous material is aerated plastic.

4. Inking mechanism according to claim 1, wherein said porous material is felt.

5. Inking mechanism according to claim 1, wherein said porous material is nonwoven material.

* * * * *